US008757031B2

(12) United States Patent
Su

(10) Patent No.: US 8,757,031 B2
(45) Date of Patent: Jun. 24, 2014

(54) PNEUMATIC DRIVEN RATCHET WRENCH

(71) Applicant: Basso Industry Corporation, Taichung (TW)

(72) Inventor: San-Yih Su, Taichung (TW)

(73) Assignee: Basso Industry Corp., Taichung (TW)

( * ) Notice: Subject to any disclaimer, the term of this patent is extended or adjusted under 35 U.S.C. 154(b) by 0 days.

(21) Appl. No.: 13/840,842

(22) Filed: Mar. 15, 2013

(65) Prior Publication Data

US 2013/0239753 A1 Sep. 19, 2013

(30) Foreign Application Priority Data

Mar. 16, 2012 (TW) ..... 101109189 A

(51) Int. Cl.

| | |
|---|---|
| ***B25B 17/00*** | (2006.01) |
| ***B25B 21/00*** | (2006.01) |
| *B25B 23/00* | (2006.01) |
| *B25B 17/02* | (2006.01) |

(52) U.S. Cl.

CPC ..... *B25B 21/005* (2013.01); *B25B 21/004* (2013.01); *B25B 23/0078* (2013.01); *B25B 17/00* (2013.01); *B25B 21/002* (2013.01); *B25B 17/02* (2013.01); *B25B 21/00* (2013.01)

USPC ..... 81/57.13; 81/57.39; 81/62; 81/57.11

(58) Field of Classification Search

CPC B25B 21/005; B25B 21/004; B25B 23/0078; B25B 17/00; B25B 21/002; B25B 17/02; B25B 21/00

USPC ..... 81/57.39, 57, 57.11, 57.13, 57.14

See application file for complete search history.

(56) References Cited

U.S. PATENT DOCUMENTS

| | | | | | |
|---|---|---|---|---|---|
| 2,508,568 | A * | 5/1950 | Ellison | 74/157 |
| 4,458,565 | A * | 7/1984 | Zilly et al. | 81/469 |
| 4,919,022 | A * | 4/1990 | Ono et al. | 81/464 |
| RE33,711 | E * | 10/1991 | Ono et al. | 81/464 |
| 5,107,729 | A * | 4/1992 | Makhlouf | 81/57.3 |
| 5,142,952 | A * | 9/1992 | Putney et al. | 81/57.39 |
| 5,535,646 | A * | 7/1996 | Allen et al. | 81/57.39 |
| 6,578,643 | B2 * | 6/2003 | Izumisawa | 173/47 |
| 6,640,669 | B2 * | 11/2003 | Izumisawa | 81/57.39 |
| 6,860,174 | B2 * | 3/2005 | Kusama | 81/57.39 |
| 8,051,746 | B2 * | 11/2011 | Bouchard et al. | 81/57.39 |
| 2012/0234139 | A1 * | 9/2012 | Chen | 81/57.11 |

* cited by examiner

*Primary Examiner* — Monica Carter

*Assistant Examiner* — Melanie Alexander

(74) *Attorney, Agent, or Firm* — Brinks Gilson & Lione

(57) ABSTRACT

A pneumatic driven ratchet wrench comprises: a wrench housing; a pneumatic motor; a ratchet wheel unit; two gear members; an urging member for biasing the gear members to engage the ratchet wheel; a transmission unit connected to the gear members and driven by the pneumatic motor; and a gear-selecting unit including an operating knob, a switching member and two pushing members. The operating knob is mounted on the wrench housing and is disposed distal from a head section of the wrench housing for driving movement of the pushing members. Each of the pushing members pushes a respective one of the gear members to move away from the ratchet wheel unit when moved from a releasing position to a pushing position.

8 Claims, 9 Drawing Sheets

PNEUMATIC DRIVEN RATCHET WRENCH

CROSS-REFERENCE TO RELATED APPLICATION

This application claims priority of Taiwanese Application No. 101109189, filed on Mar. 16, 2012.

BACKGROUND OF THE INVENTION

1. Field of the Invention

This invention relates to a pneumatic driven ratchet wrench, more particularly to a pneumatic driven ratchet wrench including a wrench housing with a head section and an operating knob disposed at a position distal from the head section for switching rotational directions of a ratchet wheel.

2. Description of the Related Art

FIG. 1 illustrates a conventional pneumatic driven ratchet wrench 1 that includes a wrench housing 11 with a head section 111 and a handgrip section (not shown), a ratchet wheel 12 mounted in the head section 111, two gear members 13, each of which is selectively engageable with the ratchet wheel 12, a swingable driving link 14, a shaft 15 with an eccentrically disposed head 151 connected to the swingable driving link 14, a cylindrical pneumatic rotor (not shown) connected to the shaft 15 and powered by a compressed air so as to co-rotate with the shaft 15, and a direction-switching unit 16 including a pinion 161 and two racks 162 disposed at two opposite sides of the pinion 161 and engaging the pinion 161. An operating knob (not shown) is connected to the pinion 161, and extends therefrom through the head section 111 of the wrench housing 11 for a user to operate in selecting a desired rotational direction of the ratchet wheel 12. In operation, when the ratchet wheel 12 is to be set to a selected rotational direction, the operating knob is rotated in a corresponding direction to drive the racks 162 to move in opposite directions such that a corresponding one of the racks 162 is moved to engage the ratchet wheel 12 and the other is moved to disengage the ratchet wheel 12.

The conventional pneumatic driven ratchet wrench 1 is disadvantageous in that since the operating knob protrudes outwardly from the head section 111 of the wrench housing 11, the overall profile of the head section 111 is considerably increased, which renders the ratchet wrench 1 unsuitable or difficult for tightening or loosening screws in a narrow space. In addition, since the operating knob is disposed at the head section 111 and since the handgrip section is disposed at a position distal from the head section 111, operation of the operating knob cannot be reached by fingers of the hand that holds the handgrip section.

U.S. Pat. No. 8,051,746 discloses a pneumatic driven ratchet wrench that is powered by a compressed air and that includes a wrench housing having a head section for accommodating a direction selector, a gear set, a yoke, a pawl engageable with the yoke, and a drive body coupled to the direction selector. A collar is mounted to the head section and engages the gear set through a right angle gear so as to cause the ratchet wrench to switch between clockwise and counterclockwise rotations. The ratchet wrench disclosed in the patent has the aforementioned drawbacks.

SUMMARY OF THE INVENTION

Therefore, the object of the present invention is to provide a pneumatic driven ratchet wrench that can overcome at least one of the aforesaid drawbacks associated with the prior art.

According to this invention, there is provided a pneumatic driven ratchet wrench that comprises: a wrench housing having a handgrip section, a head section, and a middle section disposed between and interconnecting the head section and the handgrip section; a pneumatic motor mounted rotatably in the middle section and rotatable relative to the wrench housing about a central axis; a ratchet wheel unit mounted rotatably in the head section; first and second gear members mounted in the wrench housing and disposed adjacent to the ratchet wheel unit; an urging member disposed in the wrench housing for biasing the first and second gear members to engage the ratchet wheel; a transmission unit mounted in the middle section, driven by the pneumatic motor, and including a swingable driving link that is swingable about a first axis perpendicular to the central axis, the first and second gear members being pivoted to the swingable driving link so that the first and second gear members can be simultaneously and alternately moved to and fro when the swingable driving link is driven by the pneumatic motor to swing about the first axis; and a gear-selecting unit including an operating knob, a swingable switching member that is mounted to the wrench housing, and first and second pushing members mounted slidably in the wrench housing. The operating knob is mounted movably on an exterior of the wrench housing, and is disposed distal from the head section. Each of the first and second pushing members is connected to the swingable switching member. The swingable switching member is driven to swing about a second axis by the operating knob so as to drive sliding movement of one of the first and second pushing members from a releasing position to a pushing position and simultaneous sliding movement of the other one of the first and second pushing members from the pushing position to the releasing position. The second axis is perpendicular to the central axis. Each of the first and second pushing members pushes a respective one of the first and second gear members to move away and disengage from the ratchet wheel unit when moved from the releasing position to the pushing position. Each of the first and second gear members is released from the respective one of the first and second pushing members to move toward and engage the ratchet wheel unit by the biasing action of the urging member when the respective one of the first and second pushing members is moved from the pushing position to the releasing position.

BRIEF DESCRIPTION OF THE DRAWINGS

In drawings which illustrate an embodiment of the invention.

DETAILED DESCRIPTION OF THE PREFERRED EMBODIMENT

Figure 1:
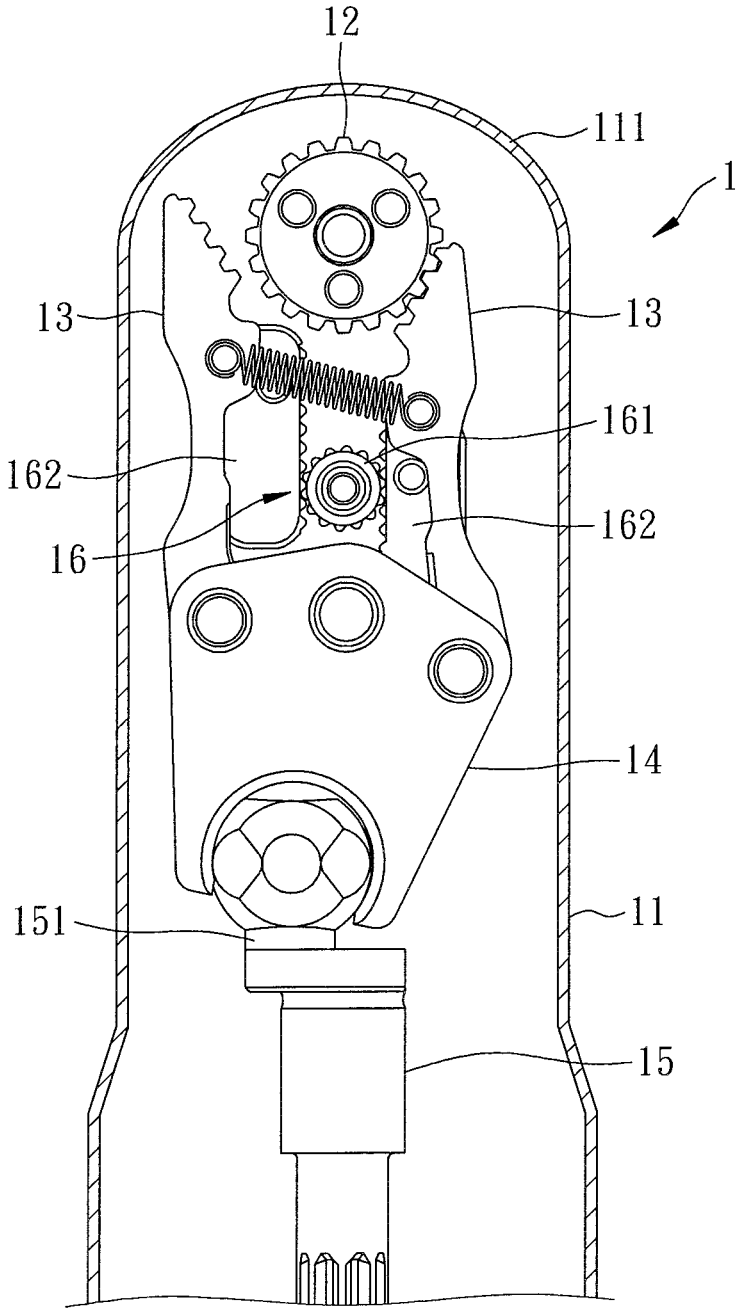
FIG. 1 PRIOR ART
FIG. 1 is a fragmentary sectional view of a conventional pneumatic driven ratchet wrench.
Figure 2:
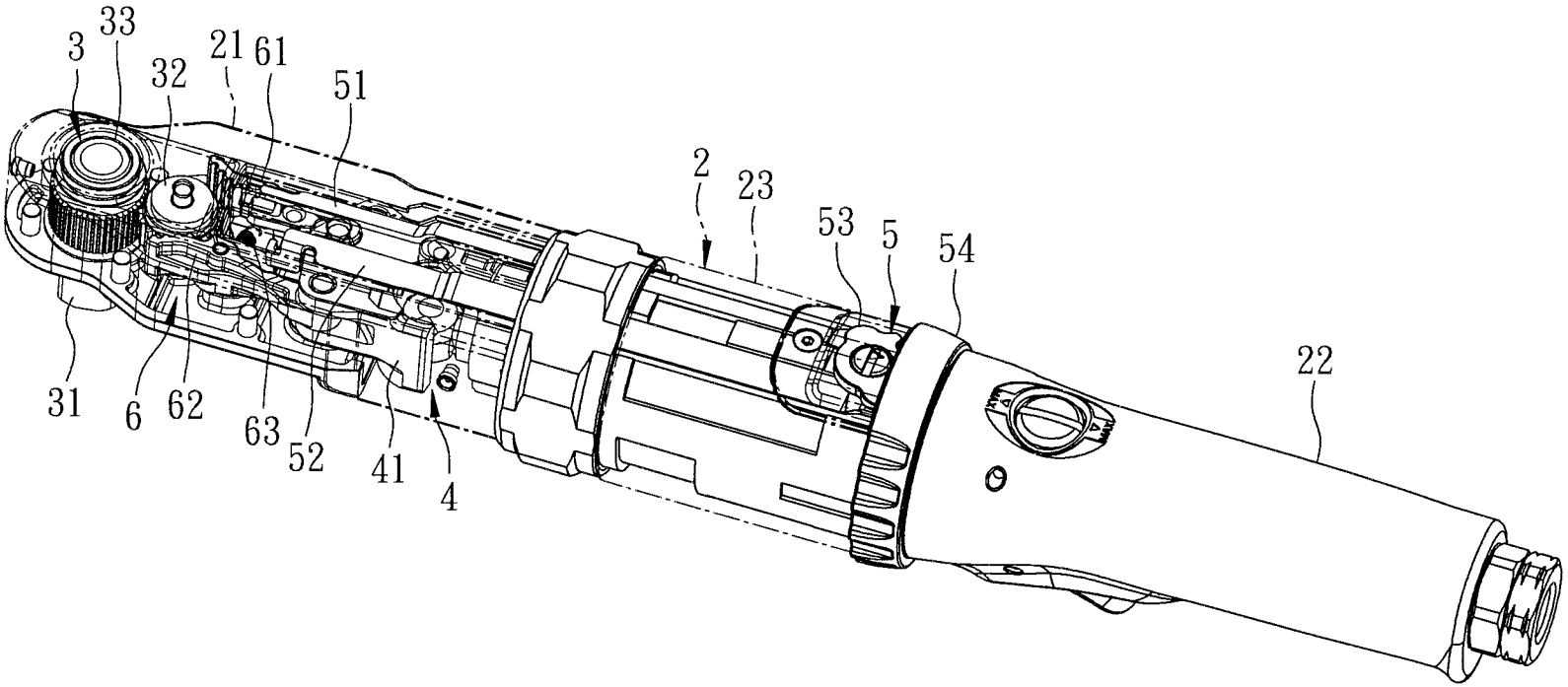
FIG. 2 is a perspective view of the preferred embodiment of a pneumatic driven ratchet wrench according to the present invention.

FIGS. 2 to 5 illustrate the preferred embodiment of a pneumatic driven ratchet wrench according to the present invention. The pneumatic driven ratchet wrench includes a wrench housing 2, a cylindrical pneumatic motor 43, a ratchet wheel unit 3, a gear driving unit 6, a transmission unit 4, and a gear-selecting unit 5.

The wrench housing 2 has a head section 21, a handgrip section 22, and a middle section 23 disposed between and interconnecting the head section 21 and the handgrip section 22. An exterior of the wrench housing 2 is formed with first and second engaging grooves 24 (see FIG. 7) that are disposed adjacent to the handgrip section 22 and that are angularly displaced from each other.

The pneumatic motor 43 is mounted rotatably in the middle section 23, and is rotatable relative to the wrench housing 2 about a central axis (X).

The gear driving unit 6 includes first and second gear members 61, 62 mounted in the head section 21 of the wrench housing 2 and disposed adjacent to the ratchet wheel unit 3, and an urging member 63 disposed in the wrench housing 2 and interconnecting the first and second gear members 61, 62 for biasing the first and second gear members 61, 62 to engage the ratchet wheel unit 3.

In this embodiment, the ratchet wheel unit 3 is mounted rotatably in the head section 21, and includes a ratchet wheel 32 and a transferring gear 33 engaging the ratchet wheel 32 and connected to a male driving tool 31. Alternatively, the transferring gear 33 can be connected to a female driving tool (not shown). Each of the first and second gear members 61, 62 is engageable with the ratchet wheel 32 for driving rotation of the transferring gear 33. Alternatively, the ratchet wheel unit 3 can dispense with the transferring gear 33, and the ratchet wheel 32 is connected with the male driving tool 31.

The transmission unit 4 is mounted in the middle section 23, and includes a shaft 42 that has an eccentrically disposed head 421 and that is connected to and driven by the pneumatic motor 43 to rotate about the central axis (X), and a swingable driving link 41 that is pivoted to the wrench housing 2 so as to be swingable about a first axis (Y) perpendicular to the central axis (X). The swingable driving link 41 is provided with a multi-face block connector 45 that is coupled to the eccentrically disposed head 421 so as to permit the swingable driving link 41 to be driven by the pneumatic motor 43 to swing about the first axis (Y). The first and second gear members 61, 62 are pivoted to the swingable driving link 41 so that the first and second gear members 61, 62 can be simultaneously and alternately moved to and fro when the swingable driving link 41 is driven by the pneumatic motor 43 to swing about the first axis (Y).

The gear-selecting unit 5 includes an operating knob 54, a swingable switching member 53, and first and second pushing members 51, 52. The first and second pushing members 51, 52 are mounted slidably in the wrench housing 2. The swingable switching member 53 is swingably mounted to the wrench housing 2. The operating knob 54 is mounted movably on an exterior of the wrench housing 2, is disposed adjacent to the handgrip section 22 and distal from the head section 21, and is coupled to the first and second pushing members 51, 52 through the swingable switching member 53 so as to drive sliding movement of either one of the first and second pushing members 51, 52 from a releasing position to a pushing position (see FIGS. 5 and 8) and simultaneous sliding movement of the other one of the first and second pushing members 51, 52 from the pushing position to the releasing position. Each of the first and second pushing members 51, 52 pushes a respective one of the first and second gear members 61, 62 to move away and disengage from the ratchet wheel 32 of the ratchet wheel unit 3 when moved from the releasing position to the pushing position. Each of the first and second gear members 61, 62 is released from the respective one of the first and second pushing members 51, 52 to move toward and engage the ratchet wheel 32 of the ratchet wheel unit 3 by the biasing action of the urging member 63 when the respective one of the first and second pushing members 51, 52 is moved from the pushing position to the releasing position.

Figure 6:
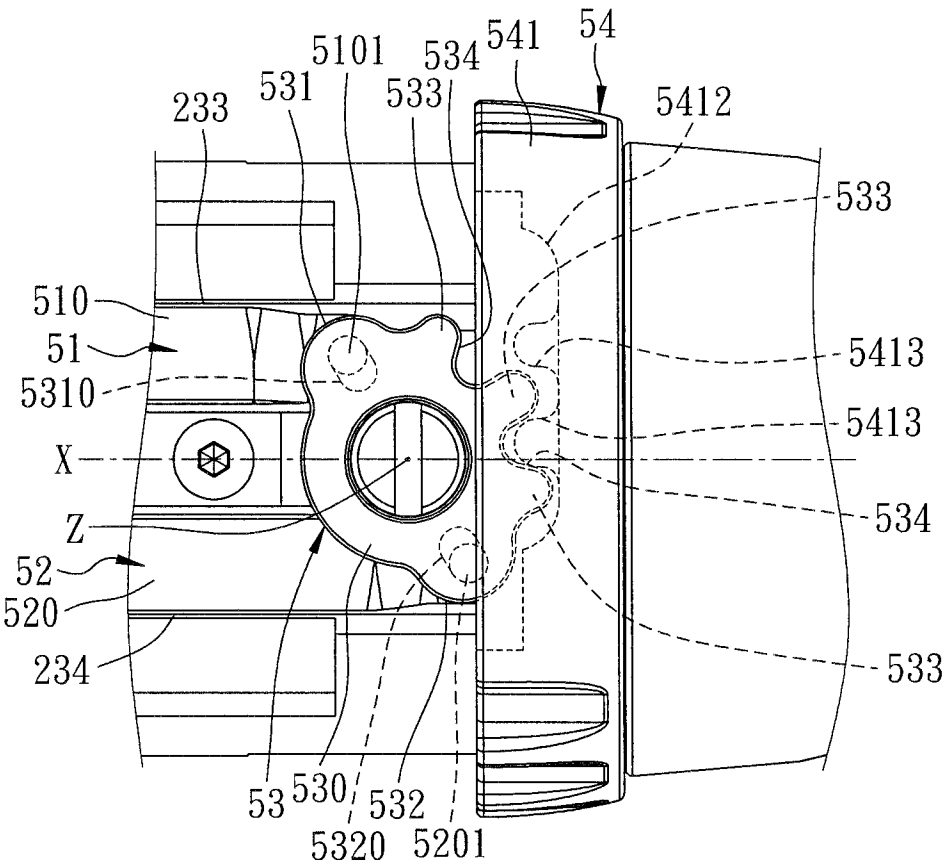
FIG. 6 is a fragmentary schematic top view illustrating engagement between a swingable switching member and an operating knob of the preferred embodiment.
Figure 7:
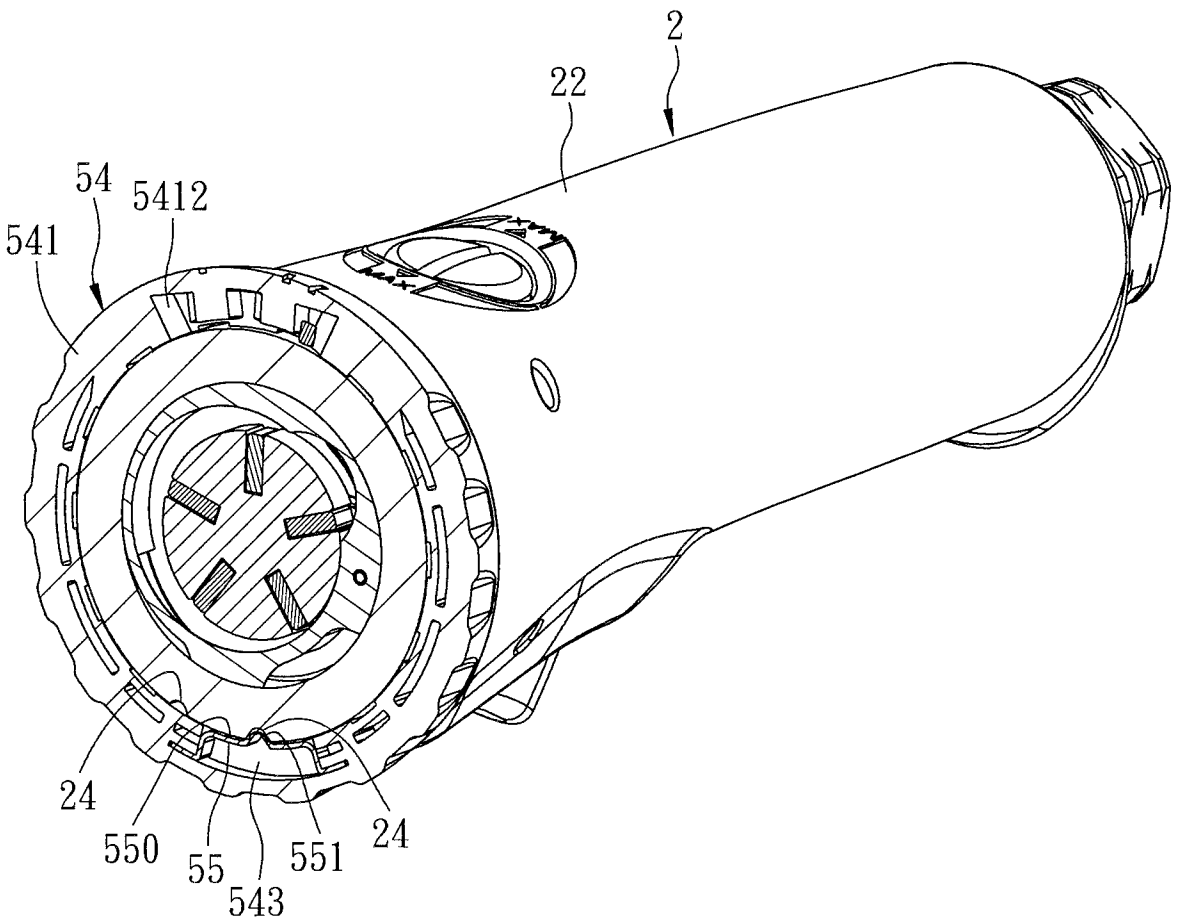
FIG. 7 is a fragmentary, partly sectional perspective view illustrating engagement between a resilient member and an exterior of a wrench housing of the preferred embodiment.

In this embodiment, as illustrated in FIGS. 6 and 7, the operating knob 54 has an annular wall 541 that is sleeved rotatably on a rear end of the middle section 23 of the wrench housing 2 at a position adjacent to the handgrip section 22, and that is rotatable relative to the wrench housing 2 about the central axis (X).

Figure 9:
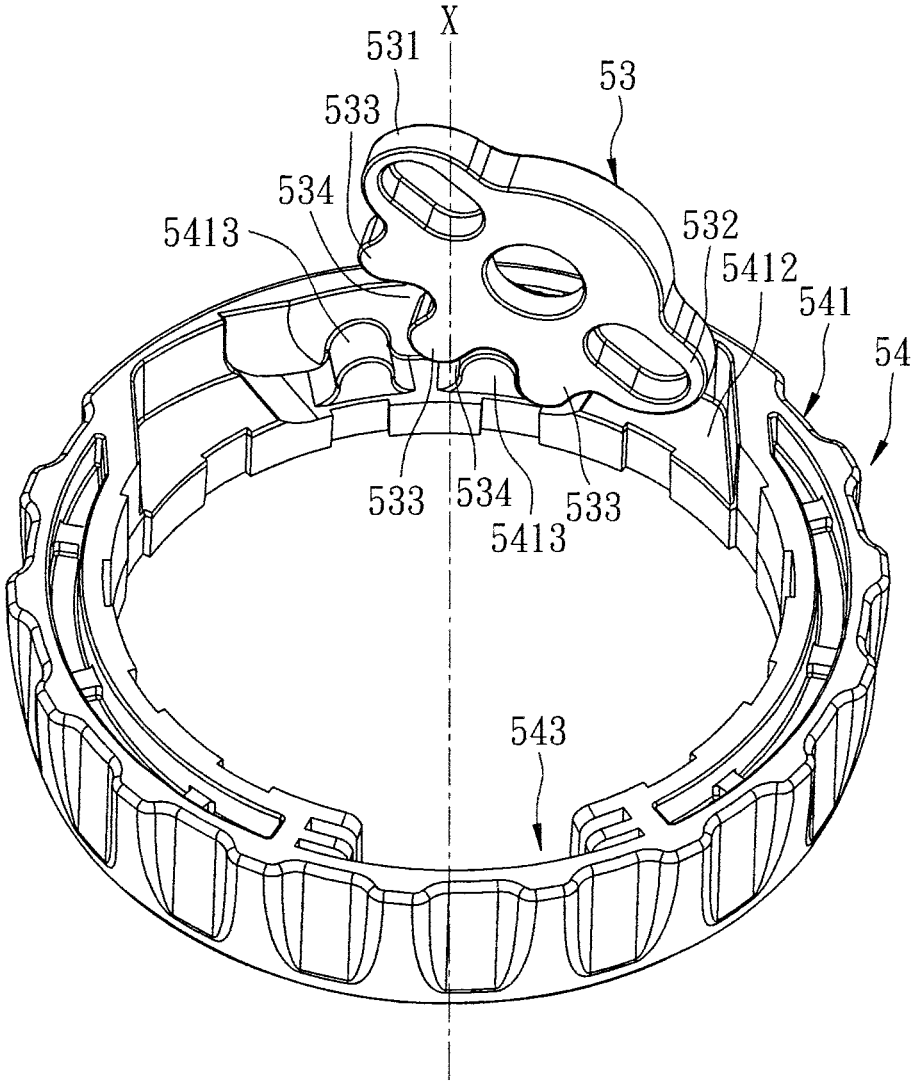
FIG. 9 is a perspective view illustrating how the operating knob engages and drives movement of the switching member of the preferred embodiment.

The swingable switching member 53 is driven by the operating knob 54 to swing about a second axis (Z) (see FIG. 4) perpendicular to the central axis (X), and engages the operating knob 54 in a tongue-and-groove engaging manner so as to be rotatable about the second axis (Z) when the operating knob 54 rotates about the central axis (X). In this embodiment, the swingable switching member 53 has a palm portion 530 pivoted to the wrench housing 2, first and second finger portions 531, 532 that are diametrically disposed relative to each other, and a plurality of third finger portions 533 that are disposed between the first and second finger portions 531, 532 and that extend from the palm portion 530 in directions perpendicular to the second axis (Z). The third finger portions 533 cooperatively define a plurality of engaging recesses 534 thereamong. The first and second pushing members 51, 52 are connected to the first and second finger portions 531, 532, respectively. The annular wall 541 of the operating knob 54 is further formed with an inner accommodating recess 5412 (see FIG. 9) for extension of the third finger portions 533 therein, and a plurality of driving protrusions 5413 protruding into the accommodating recess 5412 so as to be extended into the engaging recesses 534 and engage the third finger portions, respectively, when the operative knob 54 is rotated about the central axis (X) between first and second angular positions to drive swinging movements of the swingable switching member 53.

Figure 3:
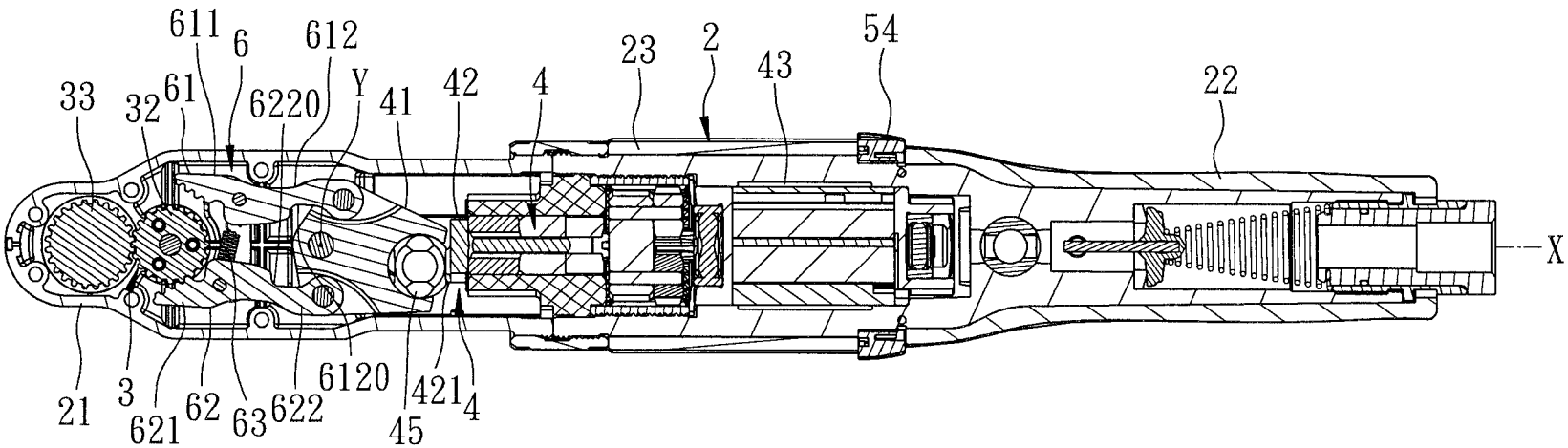
FIG. 3 is a sectional top view of the preferred embodiment.
Figure 4:
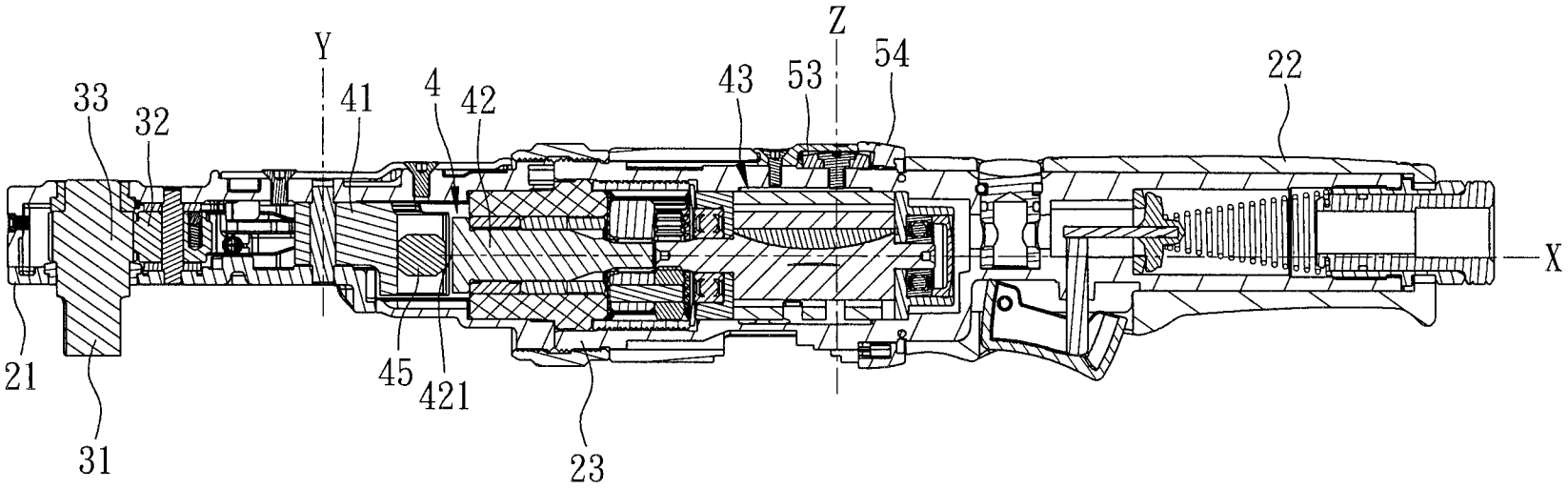
FIG. 4 is a sectional side view of the preferred embodiment.

In this embodiment, the middle section 23 of the wrench housing 2 is formed with first and second guiding grooves 233, 234 (see FIG. 5) that are parallel to each other. Referring to FIG. 3, each of the first and second gear members 61, 62 has a gear segment 611, 621 that is engageable with the ratchet wheel 32 of the ratchet wheel unit 3, and a cam-follower segment 612, 622 that extends from the gear segment 611, 621 and that defines a curved cam-follower face 6120, 6220.

Figure 5:
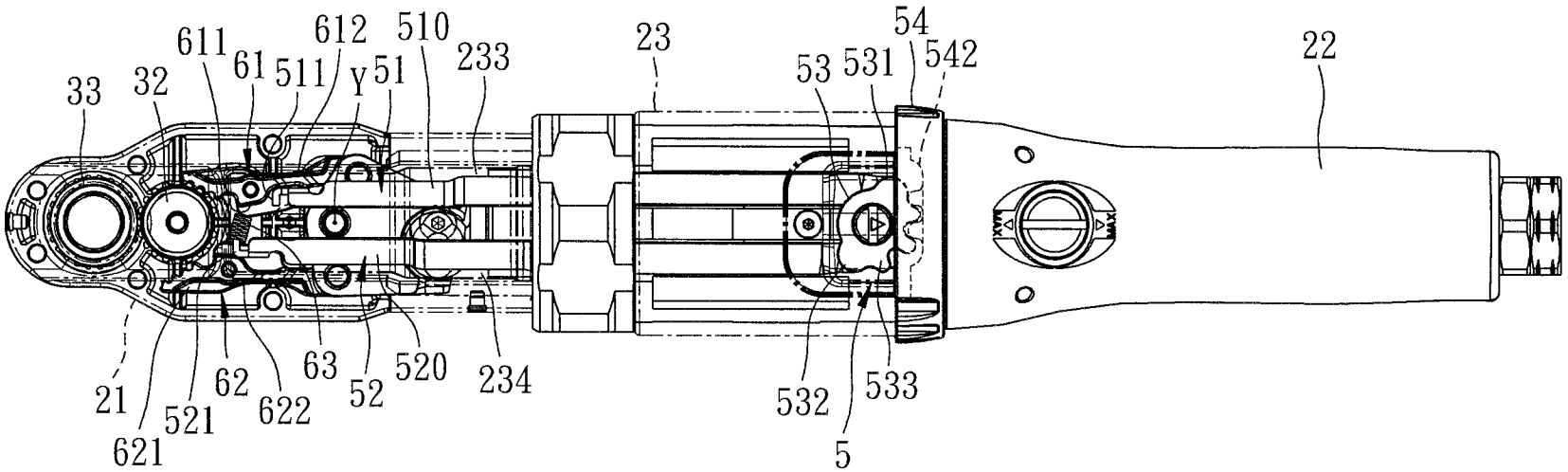
FIG. 5 is a schematic top view illustrating a first operating state of the preferred embodiment.
Figure 8:
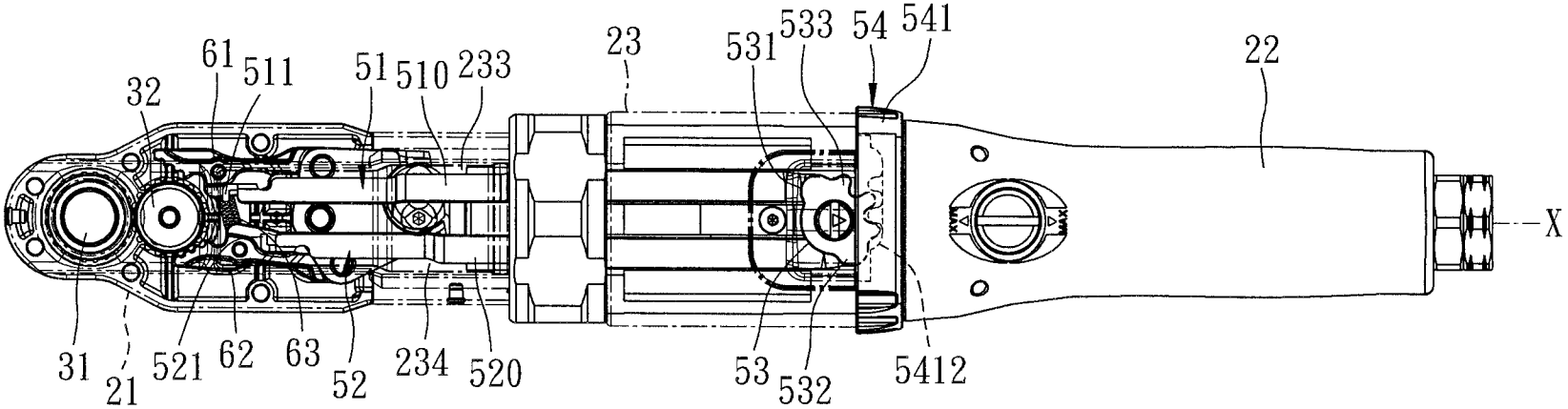
FIG. 8 is a schematic top view illustrating a second operating state of the preferred embodiment.

Referring to FIGS. 5 and 8, each of the first and second pushing members 51, 52 has a rod body 510 that is received slidably in a respective one of the first and second guiding grooves 233, 234 and that has opposite first and second ends, and a cam 511, 521 that extends from the second end of the rod body 510, 520. The first ends of the rod bodies 510, 520 of the first and second pushing members 51, 52 are connected respectively to the first and second finger portions 531, 532 of the swingable switching member 53. The cam 511, 521 of each of the first and second pushing members 51, 52 is slidable on the cam-follower face 6120, 6220 of the cam follower segment 612, 622 of a respective one of the first and second gear members 61, 62 so as to drive movement of the first and second gear members 61, 62 away from the ratchet wheel 32 of the ratchet wheel unit 3 when moving toward the ratchet wheel unit 3 and to permit movement of the first and second gear members 61, 62 toward the ratchet wheel 32 of the ratchet wheel unit 3 by the biasing action of the urging member 63 when moving away from the ratchet wheel unit 3.

Referring to FIG. 6, each of the first and second finger portions 531, 532 is formed with a slot 5310, 5320. The rod body 510, 520 of each of the first and second pushing members 51, 52 is formed with a stud 5101, 5201 extending into and slidable along the slot 5310, 5320 in a respective one of the first and second finger portions 531, 532 so as to permit the first and second pushing members 51, 52 to be driven to move between the releasing position and the pushing position by the operating knob 54.

Referring to FIG. 7, the operative knob 54 is provided with a resilient member 55 that has a bent resilient plate 550 which is mounted in the inner notch 543 in the annular wall 541, and a tongue 551 which protrudes from the resilient plate 550 and which selectively and releasably engages one of the first and second engaging grooves 24 in the exterior of the wrench housing 2 for positioning the operating knob 54 on the wrench housing 2 at a respective one of the first and second angular positions.

With the inclusion of the first and second pushing members 51, 52, the swingable switching member 53 and the operating knob 54 in the pneumatic driven ratchet wrench of this invention and by disposing the operating knob 54 at a position adjacent to the handgrip section 22 and distal from the head section 21 of the wrench housing 2, the aforesaid drawbacks associated with the prior art can be eliminated.

While the present invention has been described in connection with what is considered the most practical and preferred embodiment, it is understood that this invention is not limited to the disclosed embodiment but is intended to cover various arrangements included within the spirit and scope of the broadest interpretation and equivalent arrangements.

What is claimed is:

1. A pneumatic driven ratchet wrench comprising:

a wrench housing having a handgrip section, a head section, and a middle section disposed between and interconnecting said head section and said handgrip section;

a pneumatic motor mounted rotatably in said middle section and rotatable relative to said wrench housing about a central axis;

a ratchet wheel unit mounted rotatably in said head section;

first and second gear members mounted in said wrench housing and disposed adjacent to said ratchet wheel unit;

an urging member disposed in said wrench housing for biasing said first and second gear members to engage said ratchet wheel unit;

a transmission unit mounted in said middle section, driven by said pneumatic motor, and including a swingable driving link that is swingable about a first axis perpendicular to said central axis, said first and second gear members being pivoted to said swingable driving link so that said first and second gear members can be simultaneously and alternately moved to and fro when said swingable driving link is driven by said pneumatic motor to swing about said first axis; and a gear-selecting unit including an operating knob, a swingable switching member that is mounted to said wrench housing, and first and second pushing members mounted slidably in said wrench housing, said operating knob being mounted movably on an exterior of said wrench housing and being disposed distal from said head section, each of said first and second pushing members being connected to said swingable switching member, said swingable switching member being driven to swing about a second axis by said operating knob so as to drive sliding movement of one of said first and second pushing members from a releasing position to a pushing position and simultaneous sliding movement of the other one of said first and second pushing members from the pushing position to the releasing position, said second axis being perpendicular to said central axis;

wherein each of said first and second pushing members pushes a respective one of said first and second gear members to move away and disengage from said ratchet wheel unit when moved from the releasing position to the pushing position; and wherein each of said first and second gear members is released from the respective one of said first and second pushing members to move toward and engage said ratchet wheel unit by the biasing action of said urging member when the respective one of said first and second pushing members is moved from the pushing position to the releasing position.

2. The pneumatic driven ratchet wrench of claim 1, wherein said operating knob has an annular wall that is sleeved rotatably on said middle section of said wrench housing at a position adjacent to said handgrip section, and that is rotatable relative to said wrench housing about said central axis.

3. The pneumatic driven ratchet wrench of claim 2, wherein said swingable switching member engages said operating knob in a tongue-and-groove engaging manner so as to be rotatable about said second axis when said operating knob rotates about said central axis.

4. The pneumatic driven ratchet wrench of claim 3, wherein said swingable switching member has a palm portion pivoted to said wrench housing, first and second finger portions that are diametrically disposed relative to each other, and a plurality of third finger portions that are disposed between said first and second finger portions and that extend from said palm portion in directions perpendicular to said second axis, said third finger portions defining a plurality of engaging recesses thereamong, said first and second pushing members being connected to said first and second finger portions, respectively, said annular wall of said operating knob being formed with an inner accommodating recess for extension of said third finger portions therein, and a plurality of driving protrusions protruding into said inner accommodating recess so as to be extended into said engaging recesses and engage said third finger portions, respectively, when said operative knob is rotated about said central axis between first and second angular positions to drive swinging movements of said swingable switching member.

5. The pneumatic driven ratchet wrench of claim 4, further comprising a resilient member, an exterior of said wrench housing being formed with first and second engaging grooves, said annular wall being further formed with an inner notch, said resilient member having a bent resilient plate that is mounted resiliently in said inner notch, and a tongue that protrudes from said resilient plate and that selectively and releasably engages one of said first and second engaging grooves for positioning said operating knob on said wrench housing at a respective one of the first and second angular positions.

6. The pneumatic driven ratchet wrench of claim 1, wherein said ratchet wheel unit includes a ratchet wheel and a transferring gear engaging said ratchet wheel and adapted to be connected to a male or female driving tool, each of said first and second gear members being engageable with said ratchet wheel for driving rotation of said transferring gear through said ratchet wheel.

7. The pneumatic driven ratchet wrench of claim 1, wherein each of said first and second gear members has a gear segment that is engageable with said ratchet wheel unit, and a cam-follower segment that extends from said gear segment and that defines a curved cam-follower face, each of said first and second pushing members having a rod body that has opposite first and second ends, and a cam that extends from said second end of said rod body, said first ends of said rod bodies of said first and second pushing members being connected to said swingable switching member, said cam of each of said first and second pushing members being slidable on said cam-follower face of said cam-follower segment of a respective one of said first and second gear members so as to drive movement of said first and second gear members away from said ratchet wheel unit.

8. The pneumatic driven ratchet wrench of claim 1, wherein said urging member interconnects said first and second gear members.

* * * * *